US006718876B1

(12) United States Patent
Williamsson

(10) Patent No.: US 6,718,876 B1
(45) Date of Patent: Apr. 13, 2004

(54) METHOD AND AN APPARATUS FOR LOCKING THE ROLLERS IN A PRINTING UNIT

(75) Inventor: Peter Williamsson, Landskrona (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/937,769

(22) PCT Filed: Mar. 13, 2000

(86) PCT No.: PCT/SE00/00489

§ 371 (c)(1),
(2), (4) Date: Oct. 1, 2001

(87) PCT Pub. No.: WO00/58096

PCT Pub. Date: Oct. 5, 2000

(30) Foreign Application Priority Data

Mar. 30, 1999 (SE) ..... 9901158

(51) Int. Cl.[7] ..... B41F 13/20

(52) U.S. Cl. ..... 101/479; 101/480; 101/483; 101/153

(58) Field of Search ..... 101/479, 480, 101/145, 152, 153, 172, 209, 247, 144, 351.1, 351.4, 483

(56) References Cited

U.S. PATENT DOCUMENTS

| | | | | |
|---|---|---|---|---|
| 3,347,159 A | * | 10/1967 | Altonji et al. | 101/93.28 |
| 4,017,247 A | | 4/1977 | Soukup et al. | |
| 4,216,739 A | | 8/1980 | Wallenius | |
| 4,413,541 A | * | 11/1983 | Biggar, III | 83/346 |
| 4,462,202 A | | 7/1984 | Reil | |
| 4,759,286 A | * | 7/1988 | Witczak | 101/216 |
| 4,878,427 A | | 11/1989 | Washchynsky et al. | |
| 4,903,458 A | | 2/1990 | Hakansson | |
| 5,060,570 A | | 10/1991 | Braedle et al. | |
| 5,109,768 A | | 5/1992 | Lübke et al. | |
| 5,528,986 A | * | 6/1996 | Andersson et al. | 101/219 |
| 5,906,162 A | * | 5/1999 | Kolbe et al. | 101/352.01 |
| 6,035,615 A | | 3/2000 | Hansson et al. | |
| 6,038,838 A | | 3/2000 | Fontanazzi | |
| 6,085,495 A | | 7/2000 | Fontanazzi et al. | |
| 6,085,496 A | | 7/2000 | Fontanazzi et al. | |
| 6,112,498 A | | 9/2000 | Hansson et al. | |

FOREIGN PATENT DOCUMENTS

| | | |
|---|---|---|
| GB | 2276124 A | 9/1994 |
| WO | WO 98/08683 | 3/1998 |

* cited by examiner

*Primary Examiner*—Daniel J. Colilla
*Assistant Examiner*—Jill E Culler
(74) *Attorney, Agent, or Firm*—Burns, Doane, Swecker & Mathis, L.L.P.

(57) ABSTRACT

The disclosure relates to a method and an apparatus in a roller printing unit for locking the rollers in associated bearing housings in connection with the movement of the rollers from the open position to the working position. The movement of the rollers (2, 3) in relation to the frame of the printing unit is utilised in order, during the movement operation, to mechanically manoeuvre locking devices (14) at the bearing housings (5) of the rollers between open and closed position.

9 Claims, 2 Drawing Sheets

METHOD AND AN APPARATUS FOR LOCKING THE ROLLERS IN A PRINTING UNIT

FIELD OF THE INVENTION

The present invention relates to a method, in a roller printing unit, of locking the rollers in associated bearing housings in connection with movement of the rollers from open position to working position. The present invention also relates to a locking apparatus for rollers in a printing unit of the type in which a number of cooperating rollers suspended in a frame are movable between a working position and an open position in which the rollers are located a distance from one another and from their associated bearing housings.

BACKGROUND OF THE INVENTION

Printing units for printing web-shaped material, e.g. packaging material, are normally of the roller type, i.e. they use rollers to transfer printing ink in the desired pattern from an ink reservoir to a material web running through the printing unit. In such instance, the printing unit includes a plurality of rollers, e.g. a counterpressure roller, over which the material web runs, a stereo roller or cylinder in abutment against the counterpressure roller and whose surface displays the desired printing pattern, and an anilox (or inking) roller which is in abutment against the stereo roller and which transfers the desired quantity of ink from an ink reservoir to the stereo roller. In the working position of the printing unit, the various rollers abut against one another (but the material web runs, however, between the counterpressure roller and the stereo roller), while the rollers are separated from one another when the printing unit is in the open position, and are located a distance from one another. This allows for the replacement of the stereo roller or replacement of a part of the stereo roller, e.g. a sleeve carrying the desired artwork pattern. Naturally, the open position of the printing unit allows replacement of the remaining rollers, as well as infeed of the material web in the correct position before the printing unit is closed, i.e. the rollers are brought to the previously described working position in order, when the printing unit is in operation, progressively to transfer ink from a printing ink reservoir and to the material web passing through the unit. It is of major importance that the maneuvering of the printing unit between the open and closed positions can take place in a rapid and smooth manner, since it is often necessary to replace the stereo roller carrying the artwork or a part of the roller at relatively short intervals. A rapid and reliable replacement of the rollers is also naturally of major importance.

In prior art types of roller printing units, the stereo and anilox rollers are normally displaced between closed and open position along a linear guide (often extending more or less vertically). In such instance, the rollers are carried by bearing housings which are movable along the linear guide. In order to make for replacement of the rollers, the bearing housings have a removable, upper section which functions as a locking device, which may either be connected to the rest of the bearing housing by means of mechanical unions, such as screws or bolts, and hereby be removed entirely manually, or may be movable hydraulically or pneumatically. In the first-mentioned case, replacement of, for example, a stereo roller requires the manual dismounting of the upper sections or locking devices of the bearing housings (or alternatively the whole bearing housing), replacement of the roller, and also manual remounting and alignment. A more rapid replacement is made possible in the above-mentioned hydraulic or pneumatic constructions in which the locking device may be removed automatically during the movement of the rollers and bearing housings to the open position, and be re-activated when the rollers are moved, after replacement of, for example, the stereo roller, in a direction towards the closed position or working position in which the rollers once again abut against one another. However, hydraulic or pneumatic constructions are relatively bulky and it has also proved in practice that this type of construction not always operates with the desired reliability and precision.

There is thus a general need in the art to realize, in roller printing units, a method of locking the rollers in associated bearing housings, the method not suffering from the above-outlined drawbacks but making for rapid and simple locking and release, respectively, in connection with movement of the rollers of the printing unit between the open and closed position.

SUMMARY OF THE INVENTION

One object of the present invention is to realize a method, in a roller printing unit, of locking the rollers in associated bearing housings in connection with the movement of the rollers from the open position to the working position, the method being automatic and totally synchronized with the movement of the rollers.

A further object of the present invention is to realize a method of the type disclosed by way of introduction, the method affording reliable function and also making it possible to obviate the shortcomings in reliability and precision inherent in prior art methods.

The above and other objects have been attained according to the present invention in that a method of the type described by way of introduction has been given the characterizing feature that the movement of the rollers in relation to the frame of the printing unit is mechanically transferred to and maneuvers locking devices at the bearing housings of the rollers between open and closed position.

Preferred embodiments of the method according to the present invention have further been given the characterizing features as set forth in appended subclaims 2 to 4.

There is further a general need in the art to realize an automatic locking apparatus for rollers in a printing unit, the locking apparatus being of simple and economical design and construction which may readily be adapted to and employed in printing units of the customary major types.

One object of the present invention is thus to realize a locking apparatus for rollers in a printing unit of the type in which cooperating rollers are movable between a working position and an open position, the locking apparatus being of simple construction and requiring neither manual labor inputs nor complicated hydraulic or pneumatic drive means.

A further object of the present invention is to realize a locking apparatus of the above-mentioned type, the locking apparatus permitting, on the one hand, reliable locking of the stub shafts of the rollers in associated bearing housings, and, on the other hand, good accessibility when the rollers are to be replaced and the locking apparatus is located in its open position.

Yet a further object of the present invention is to realize a locking apparatus of the type described by way of introduction, the locking apparatus being of a construction which permits a totally automated function independently of either manual labor inputs or separate drive means of, for example, the pneumatic, hydraulic or electric type.

Still a further object of the present invention is, finally, to realize a locking apparatus of the above-mentioned type which does not suffer from the drawbacks inherent in previously mentioned apparatuses.

The above and other objects have been attained according to the present invention in that a locking apparatus of the type described by way of introduction has been given the characterizing features that the bearing housings include locking devices for the rollers, the locking devices being disposed to cooperate with maneuvering devices mounted on the frame such that, in the working position of the rollers, they are located in a closed position, and in the open position of the rollers are located in an open position.

Preferred embodiments of the apparatus according to the present invention have further been given the characterizing features as set forth in appended subclaims 6 to 9.

BRIEF DESCRIPTION OF THE DRAWINGS

One preferred embodiment of both the method and the apparatus according to the present invention will now be described in greater detail hereinbelow, with particular reference to the accompanying, schematic Drawings which show only those parts and details essential to an understanding of the present invention. In the accompanying Drawings.

DETAILED DESCRIPTION OF THE INVENTION

Figure 1:
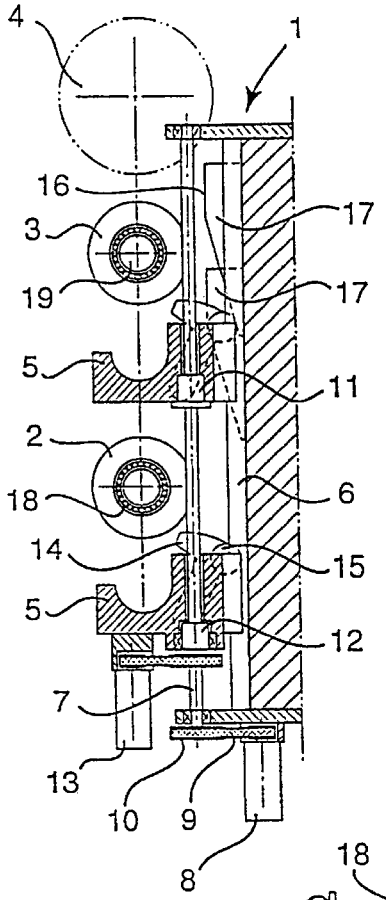
FIG. 1 is a side elevation, partly in section, of a roller printing unit with locking apparatuses according to the present invention.
Figure 2:
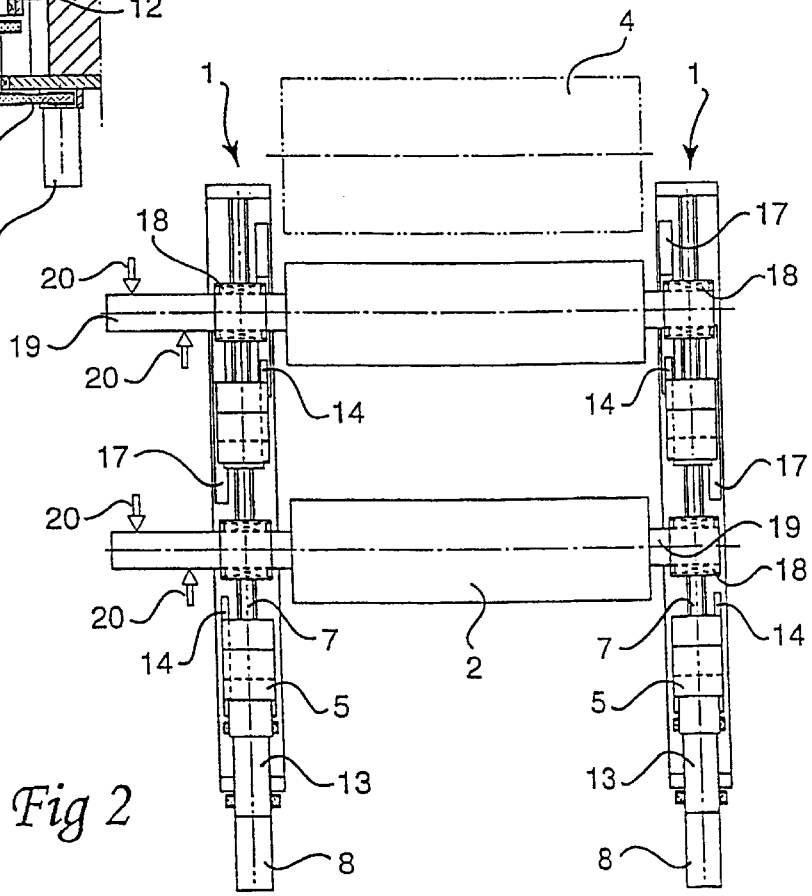
FIG. 2 is a front elevation of the printing unit according to FIG. 1.

The printing unit illustrated in FIGS. 1 and 2 includes a frame 1 which, in a per se known manner, includes two mutually spaced-apart vertical sections between which a number of rollers are rotatably suspended. More precisely, the printing unit comprises, counting from beneath and upwards, an anilox roller 2 for taking up ink from an ink reservoir (not shown), e.g. an ink bath disposed beneath the roller, a stereo roller 3 whose surface displays the desired printing pattern, either in the form of a removable sleeve carried on the surface, or a pattern engraved in the surface, and also a counterpressure roller 4 which is disposed above the stereo roller and which is cylindrical, smooth and over which a material web (not shown) runs in such a manner that, on operation of the unit, it runs through the nip between the stereo roller 3 and the counterpressure roller 4. The counterpressure roller 4 may, in a conventional manner, be suspended in a second (not shown) frame a slight distance from the frame 1 which is indicated in the Figures. Naturally, the frame may—depending on the printing method currently being employed—also carry additional rollers of other types, which in all likelihood will be obvious to a person skilled in the art.

The anilox roller 2 and the stereo roller 3 are both supported each by its pair of upwardly open bearing housings 5 which are movable in the vertical direction along the frame 1. The bearing housings 5 are designed with sliding surfaces adapted to vertical linear guides 6 in the frame 1, e.g. dovetail grooves. Driving of the bearing housings 5 vertically in relation to the frame takes place with the aid of, for example, ball screws 7 which are rotatably journalled in the frame and which, at their lower ends, are drivable by means of servo motors 8, for instance by the intermediary of belts 9 and pulleys 10 mounted on the ball screws 7. The ball screws 7 act on the bearing housings 5 via nuts 11, 12 disposed in the bearing housings, of which the nut 12 located in the lower bearing housing is rotatably disposed in relation to the bearing housing, and also rotatable by means of an additional servo motor 13 which is supported by the lower bearing housing 5. Mutual adjustment of the distance between the two bearing housings 5 is hereby made possible.

As will be particularly apparent from FIG. 1, each bearing housing 5 supports a locking device in the form of a catch 14 which is angled and, at its upper end, is pivotally journalled in each respective bearing housing 5. At the upper portion of the catches 14 facing away from the rollers, each catch 14 carries a trundle or heel 15 which is intended to cooperate with the sliding surfaces 16 on two cams 17, namely an upper cam for cooperation with the upper bearing housing 5 and a lower cam for cooperation with the lower bearing housing 5. The cams 17 are vertically adjustably connected to the frame 1 and are oriented such that they are located with their uppermost portion most proximal the working position of each respective roller. The catches 14 may be spring biased in a direction towards their open position, i.e. the position illustrated in FIG. 1. Alternatively, the catches 14 may be of such design that they are automatically actuated by force of gravity to the open position when are they are not in contact with the cams 17. The cams 17 are of such height that, when the bearing housings 5 are located in their upper positions (the position when the printing unit is located in working position with the rollers abutting against each other), they force the two catches 14 to pivot counterclockwise in FIG. 1 until the parts of the catches 14 projecting to the left abut against the roller bearing 18 of each respective roller 2, 3 and thereby prevent the roller from leaving the bearing housing 5.

As will be particularly apparent from FIG. 2, each roller 2, 3 includes projecting stub shafts 19 which support the above-mentioned roller bearings 18 in the form of, for example, anti-friction bearings. At the one end of the rollers (to the left in FIG. 2), the stub shafts 19 have an extension which is mechanically supported in support points 20 (to the left in FIG. 2) when the rollers, in the open position of the printing unit, have been removed from each respective bearing housing 5 in order to make for replacement of the roller or alternatively replacement of a stereo plate or sleeve disposed on the roller. This is a per se known technique which is not likely to need any detailed description in this context.

Figure 3:
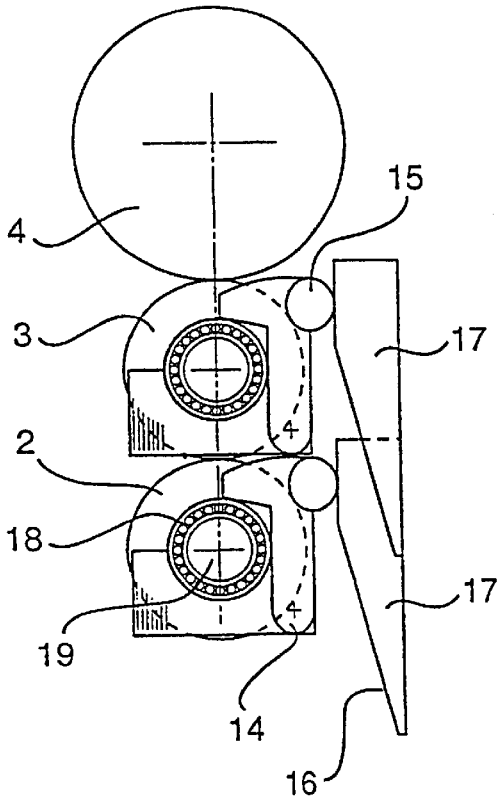
FIG. 3 is a schematic side elevation of locking apparatuses according to the present invention in the closed position.

The arrangement according to the present invention is shown in the closed position or working position of the printing unit in FIG. 3. FIG. 3 is schematic and shows only those parts essential to an understanding of the present invention, e.g. the different rollers 2, 3 and 4, the cams 17, as well as the catches 14 and the cooperation between the various parts of the locking apparatus when the rollers, in the closed position of the printing unit, are retained in each respective bearing housing 5 with the aid of the activated locking devices or catches 14.

Figure 4:
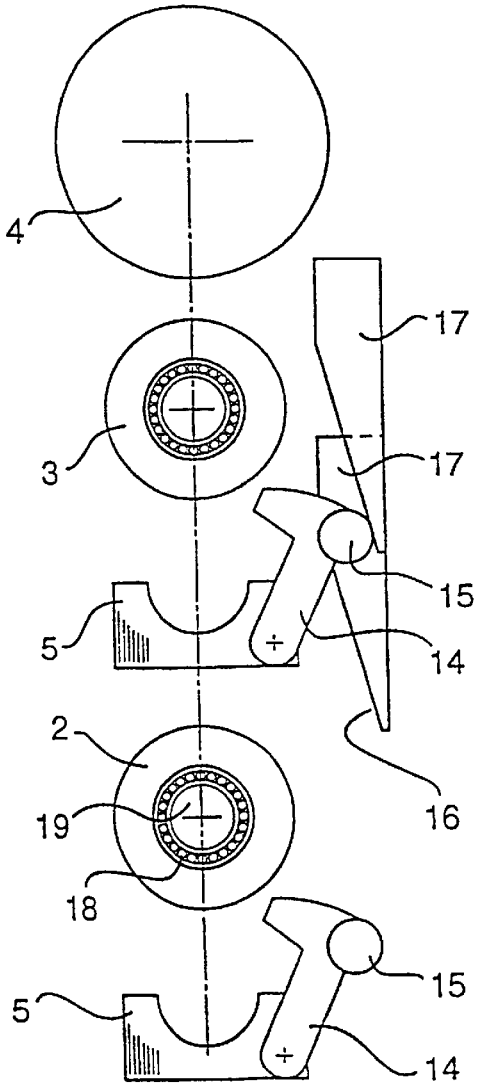
FIG. 4 is a schematic side elevation of the locking apparatuses according to FIG. 3 in the open position.

In a manner corresponding to that in FIG. 3, FIG. 4 schematically shows the essential parts of the present invention in the open position. It will here be apparent how the catches 14 of the two bearing housings 5, on vertical downward displacement with the aid of the sliding surfaces 16 and possibly spring biasing, are moved to the open position in which the stub shafts 19 of the rollers 2, 3 may leave the bearing housings 5 without hindrance. In such instance, the rollers 2 and 3 are, as shown in FIG. 2, supported in the support points 20 at the one stub shaft 19.

When a printing unit with locking apparatuses according to the present invention is, on printing of web-shaped material, to be switched for printing with new artwork, a replacement of the stereo roller 3 or a stereo plate or sleeve disposed thereon and carrying the printed artwork is required in a per se known manner. In order to make this possible, the stereo roller must be made accessible for replacement, which takes place in that the rollers 2, 3 are displaced away from one another and the counterpressure roller 4 by substantially vertical downward movement along the frame 1. More precisely, the servo motors 8 are here activated and, by the intermediary of the belts 9 and pulleys 10, rotate the ball screws 7 in such a direction that the bearing housings 5 are displaced downwards along the frame 1, guided by the engagement between each respective bearing housing 5 and the linear guides 6 of the frame 1. However, in this instance the two bearing housings 5 are displaced at the same time and at the same speed. In order to make for additional movement of the lower bearing housing 5 so that the distance between the two bearing housings increases, the servo motor 13 is also activated and rotates the nut 12 rotatably journalled in the lower bearing housing 5 so that the lower bearing housing 5 is moved a further distance downwards, away from the upper bearing housing 5. When, during the opening movement, the two bearing housings 5 pass the levels at which the above-mentioned support points 20 (indicated in FIG. 2) for the extended stub shafts 19 are located, the two rollers are retained in these vertical positions at the same time as the bearing housings 5 are moved a further distance downwards.

Separation of the two rollers 2, 3 from associated bearing housing 5 presupposes that the locking apparatuses according to the present invention make it possible to release the roller stub shafts 19 from the bearing housings 5. This is put into effect already in the first phase of the downward movement of the rollers along the frame 1. As will be particularly apparent from FIG. 3, the trundles 15 of the locking devices or catches 14 will, already after a short downward displacement, depart from the planar section of the sliding surfaces 16 of the cams 17. In such instance, the catches 14 will, because of their spring biasing in a direction towards the open position (or alternatively because of the force of gravity), progressively pivot in a clockwise direction around the bearing point in each respective bearing housing 5 until such time as the catches 14 are located in the wholly open position which is illustrated in FIG. 4. At this point, the front portions of the catches 14 have come vertically outside the stub shafts 19 so that the bearing housings 5 may be moved a further distance downwards without being prevented from doing so by the catches 14. Since the movement of the catches 14 is mechanically guided by the cams 17 supported by the frame 1, this will take place fully automatically in a predictable and repeatable manner every time the bearing housings 5 are moved downwards in a direction from the working position of the printing unit to its open position. In a corresponding manner, the pivoting of the catches 14 from open to closed position will naturally take place automatically and with great precision when the bearing housings 5, after roller replacement, are once again moved upwards until such time as the rollers come into abutment against each other and the printing unit is ready for continued printing. Naturally, this takes place in a corresponding manner, i.e. in that the servo motors 8, 13 are once again activated in order, by the intermediary of belts and pulleys, to drive the ball screw 7 and the nut 12, respectively, in opposite directions until the rollers have assumed the desired vertical position.

As will have been apparent from the foregoing description, the method according to the present invention affords reliable and dependable function, since the actuation of the locking devices is entirely mechanical and is automatically controlled on vertical movement of the rollers of the printing unit between the working position and the open position. No manual handling is necessary and, as a result, the method according to the present invention will, in practice, also be considerably more rapid than prior art methods. The apparatus according to the present invention displays a dependable and reliable function, simple construction which is based on simple and uncomplicated mechanics and does not require the employment either of manual fitting and assembly parts or any form of additional drive means, e.g. hydraulic, pneumatic or electric means for operating the locking devices. As a result, the design and construction are economical and reliable and may also be made so compact that it will be possible to employ the apparatus in current, known types of printing units.

What is claimed is:

1. In a roller printing unit, a method of locking rollers in associated bearing housings comprising: moving the rollers translationally in relation to the printing unit from an open position to a working position, and mechanically transferring said movement to maneuver said locking devices at the bearing housings of the rollers between open and closed positions.

2. The method as claimed in claim 1, wherein movement of the rollers from the working position towards the open position comprises opening the locking devices at the bearing housings.

3. The method as claimed in claim 2, further comprising continuously subjecting the locking devices to a force in a direction towards the open position of the locking devices.

4. The method as claimed in claim 3, further comprising on roller movement, influencing the locking devices with a sloping plane connected to the frame.

5. A locking apparatus for rollers in a printing unit of the type in which a number of cooperating rollers suspended in a frame are movable between a working position and an open position in which the rollers are located a distance from one another and from associated bearing housings, wherein the associated bearing housings include locking devices for the rollers, said locking devices being disposed to cooperate with maneuvering devices mounted on the frame such that, in the working position of the rollers, the locking devices are located in a closed position, in the open position of the rollers, the locking devices are located in an open position, and translational movement of the rollers in relation to the frame maneuvers the locking devices via the maneuvering device.

6. The locking apparatus as claimed in claim 5, wherein the locking devices are of mechanical type and are movably connected to associated bearing housings and, in the working position of the rollers, the locking devices are disposed by mechanical influence from a sliding surface on the frame, to be held in a position in which the roller stub shaft is retained in the bearing housing.

7. The locking apparatus as claimed in claim 6, wherein each locking device comprises a catch which is pivotally journalled in the bearing housing.

8. The locking apparatus as claimed in claim 7, wherein each catch is spring-biased in a direction towards the open position of the corresponding locking device.

9. The locking apparatus as claimed in claim 6, wherein the sliding surface is supported by a cam connected to the frame and oriented with its highest portion most proximal the working position of the rollers.

* * * * *